US007322867B2

(12) United States Patent
Blakely

(10) Patent No.: US 7,322,867 B2
(45) Date of Patent: Jan. 29, 2008

(54) SURFBOARD DECK GRIP WITH STORAGE COMPARTMENT

(76) Inventor: John Ford Blakely, 13697 Calais Dr., Del Mar, CA (US) 92014

( * ) Notice: Subject to any disclaimer, the term of this patent is extended or adjusted under 35 U.S.C. 154(b) by 0 days.

(21) Appl. No.: 11/139,092

(22) Filed: May 26, 2005

(65) Prior Publication Data

US 2006/0270289 A1 Nov. 30, 2006

(51) Int. Cl.
*B63B 35/81* (2006.01)

(52) U.S. Cl. ..... 441/74; 441/65

(58) Field of Classification Search ..... 441/65, 441/74, 68, 79; 114/39.12, 39.14
See application file for complete search history.

(56) References Cited

U.S. PATENT DOCUMENTS 3,463,116 A * 8/1969 Dawson ..... 440/39
4,955,835 A * 9/1990 Hollingsworth ..... 441/74
5,127,860 A * 7/1992 Kraft ..... 441/74
5,435,765 A * 7/1995 Fletcher ..... 441/74
5,766,051 A * 6/1998 Messer ..... 441/65
6,311,631 B1 * 11/2001 Beecher ..... 441/74
6,767,264 B2 * 7/2004 Mercer ..... 441/65
2005/0106961 A1 * 5/2005 Larkin ..... 441/74

FOREIGN PATENT DOCUMENTS

AU 199054940 A1 * 11/1990

* cited by examiner

*Primary Examiner*—Lars A. Olson
(74) *Attorney, Agent, or Firm*—Morrison & Foerster LLP

(57) ABSTRACT

A surfboard deck grip with a storage compartment for safely storing small articles. The storage compartment is optionally waterproof, and does not interfere with the act of surfing. The storage compartment may further include a vessel that is optionally removable from the surfboard deck grip.

9 Claims, 12 Drawing Sheets

SURFBOARD DECK GRIP WITH STORAGE COMPARTMENT

BACKGROUND OF THE INVENTION

1. Field of the Invention

The present invention relates to surfboard deck grips or traction pads, and more particularly, to surfboard deck grips or traction pads having a storage compartment therein.

2. Background of the Invention

Surfboard deck grips (also sometimes known as traction pads) are well known in the art. For example, Gorilla Grip™, X-Trac™, K-Grip™, On a Mission™, Sticky Bumps™, and many other models are commercially available. They are often made of polymer or polymer foam materials such as polyurethane, and adhered to a surfboard deck using various types of adhesives. None of the present models, however, include a storage compartment for safely storing small articles.

While surfing, surfers usually dress in swimwear and/or a wet suit. Although swimwear and wet suits sometimes provide pockets for storing very small articles, such pockets often do not provide the space or reliability for securely storing valuable items that a surfer may desire to keep in his or her-possession. Examples of such small articles include sunscreen, wax, car keys, cell phones, identification cards, money, charge cards, eyeglasses, and so forth. Furthermore, storing such items in a pocket of swimwear or a wet suit is often uncomfortable and inconvenient for the surfer.

Consequently, there is a pressing need for surfers to have a place to safely store small articles, that is optionally waterproof, and that does not interfere with the act of surfing.

BRIEF SUMMARY OF THE INVENTION

The present invention provides a surfboard deck grip with a storage compartment for safely storing small articles. The storage compartment is secure, easily accessible, optionally removable, optionally waterproof, and does not interfere with the act of surfing.

DETAILED DESCRIPTION OF THE INVENTION

Figure 1A:
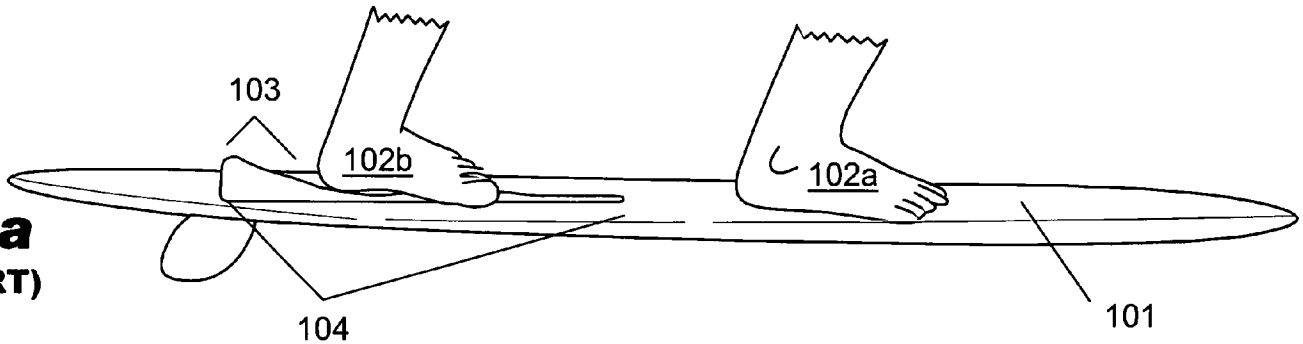
Fig. 1a (PRIOR ART)
FIGS. 1*a* and 1*b* illustrate a positioning of a surfer's feet on a surfboard deck having a surfboard deck grip.
Figure 1B:
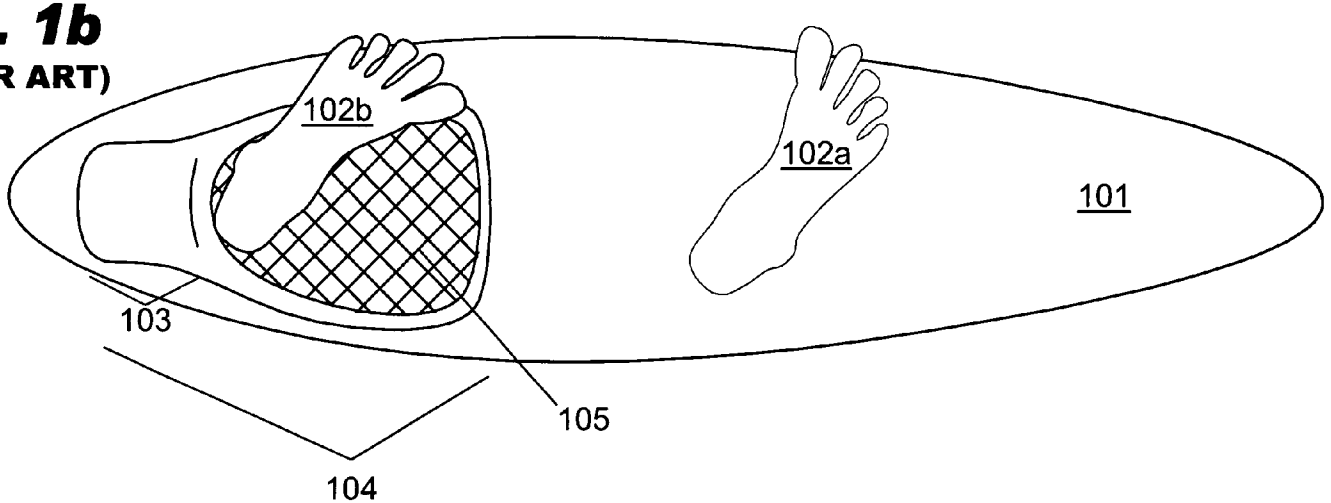
Fig. 1b (PRIOR ART)
Figure 2:
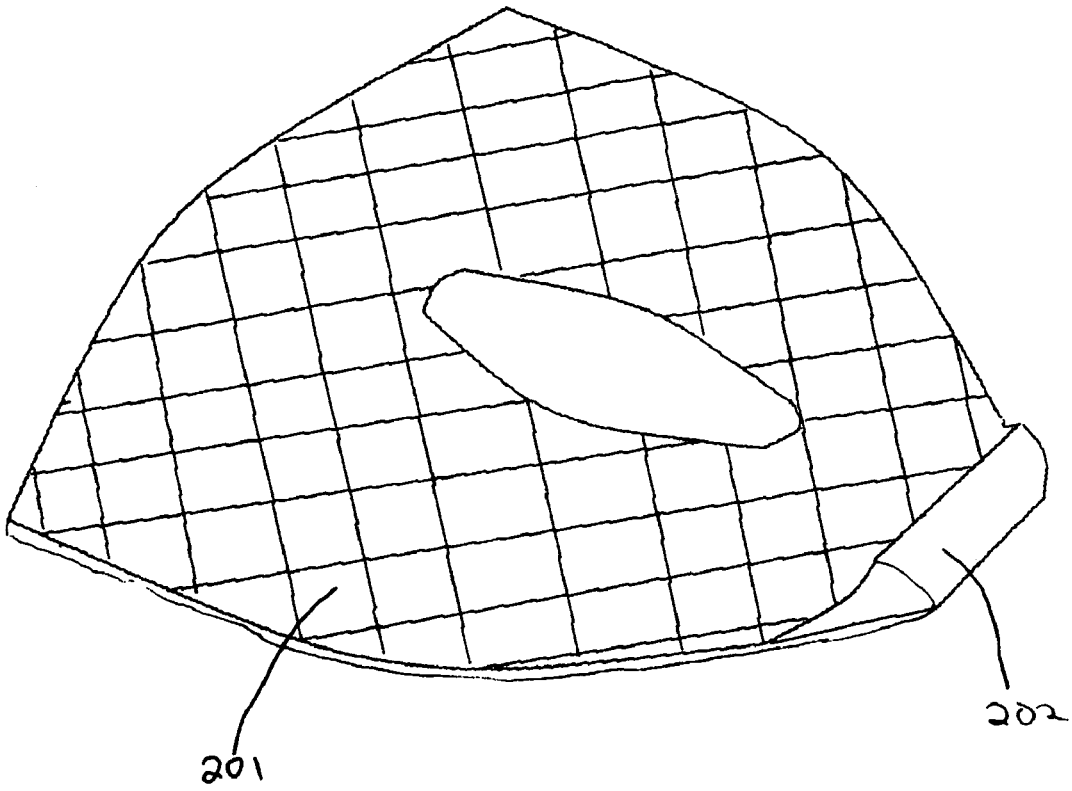
Fig. 2 (PRIOR ART)
FIG. 2 illustrates a surfboard deck grip with a kick tail.

In order to maintain good foot traction while standing on a surfboard, the deck of the surfboard is often treated with wax. Unfortunately, the wax tends to wear away with use, and must be reapplied. Additionally, the wax coating can melt and/or become dirty which reduces aesthetic appeal. One substitute for wax is a deck grip. FIG. 1 illustrates a surfboard 101 having a deck grip 104. FIG. 1*a* shows a side view, and FIG. 1*b* shows a top view. Deck grip 101 may be affixed using an appropriate adhesive or glue as is well known to one of ordinary skill in the art. Deck grip 104 provides a foot traction portion 105 for foot 102*b*, as well as a kick tail portion 103 configured to support or abut against a side or heel of foot 102*b*. Deck grip 101 is not necessarily drawn to scale in FIG. 1. A deck grip may also be used for foot 102*a*, although this has not been illustrated. Often surfers prefer not to use a deck grip for foot 102*a*, because of chest chafing while lying on surfboard. FIG. 2 illustrates a perspective view of a typical, commercially available deck grip 201 having a kick tail 202. As is well-known in the art a "kick tail" refers to a raised or upwardly inclined portion of a deck grip, typically located at or near a rear portion of the deck grip to provide support and stability to a rear foot of a surfer during surfing.

A deck grip may be made of any suitable material, including rubber, solid polymers, polymers with elastomeric properties, and polymers with open or closed cell foam structures. It is important that the material has sufficient mechanical strength, including impact and abrasion resistance, while possessing adequate environmental hardness to sea water, ultraviolet light, and temperature extremes. Typical polymer materials include, for example, polyurethane, polybutadiene, polystyrene/polybutadiene copolymers, PVC, ABS, polymethylsiloxane (Silicone®) and many others that are well known to one of ordinary skill in the art. Alternately, composite materials may be used. If the deck grip is to be affixed to the surfboard deck by gluing, the polymer is chosen to be compatible with the adhesive or glue that is to be used. Such adhesives and glues are also well known to one of ordinary skill in the art.

Figure 3:
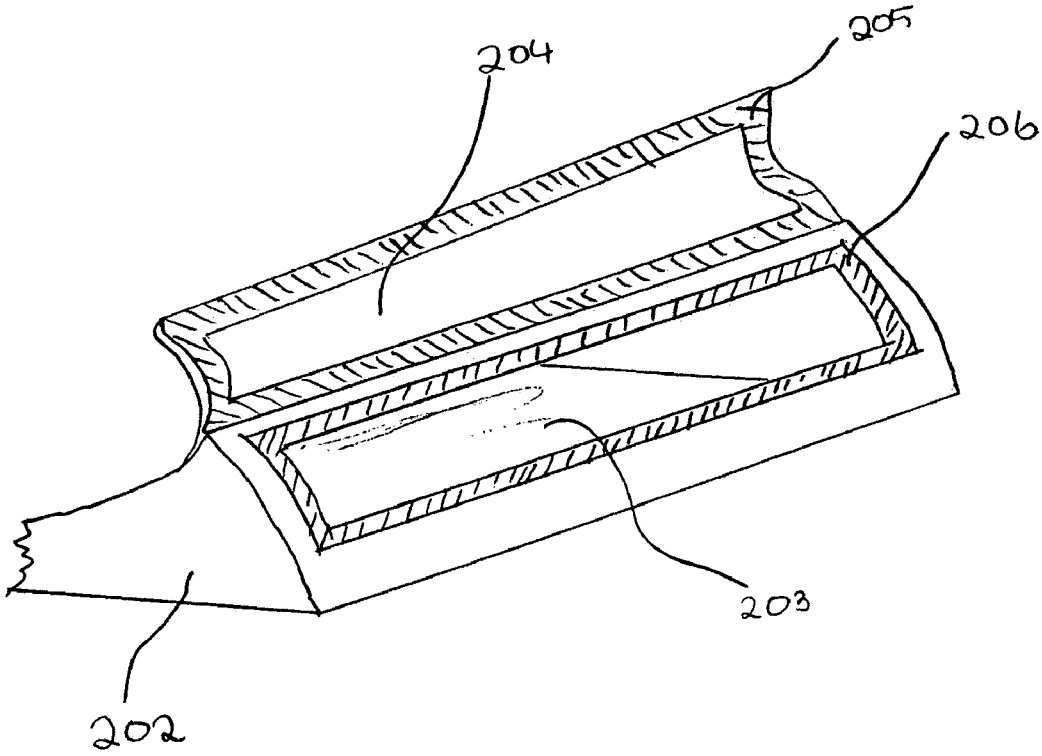
FIG. 3 illustrates an embodiment of the invention with a kick tail that includes a storage compartment.

FIG. 3 illustrates an embodiment of the present invention in which kick tail 202 has been modified to contain a storage compartment 203. Flap 204 is used to seal storage compartment 203, thereby securing any contents that may be therein. When storage compartment 203 is sealed by flap 204, kick tail 202 functions as a normal kick tail for a surfboard deck grip, and does not interfere with the act of surfing. Mating sealing means 205 and 206 are used to hold flap 204 in place when sealed. In an embodiment, mating sealing means 205 and 206 may be strips of hook and loop materials such as Velcrog, that are secured to flap 204 and kick tail body 202 using adhesives, glues, or mechanical fastening means as are well known to one of ordinary skill in the art. Flap 204 may be composed of an environmental appropriate fabric such as Nylon®, polyester, or others. Alternately, flap 204 may be composed of a sheet of solid, flexible material, such as one of the environmentally compatible polymers described, above. Flap 204 may be permanently attached to kick tail body 202 (by means that are well known to one of ordinary skill in the art) along one or more sides as shown in FIG. 3, in order to prevent its loss when compartment 203 is unsealed, and also to facilitate alignment for the mechanical operation of sealing. Mating sealing means 205 and 206 may be made of other materials than hook and loop materials. For example, mating sealing means 205 and 206 may form an interlocking tongue and groove sealing system (e.g. ZipLock®, or others). Other types of mechanical fasteners may also be used such as zippers, buttons and button holes, mechanical snap assemblies, looped cords and securing studs, etc. . . . as are well known to one of ordinary skill in the art. Mating sealing means 205 and 206 may or may not form a water tight seal. Storage compartment 203 may have no lining (i.e. the inside of the material comprising kick tail 202 serves as the lining), or it may be lined with an additional material for improved rigidity to resist compartment 203's collapsing under external weight or pressure. The lining may be permanently installed within compartment 203, or it may be removable and re-insertable. The lining may be any appropriately stiff polymer, metal, or metal alloy. In a further embodiment, a removable vessel for storing items may be used in lieu of, or in addition to the lining.

Figure 4:
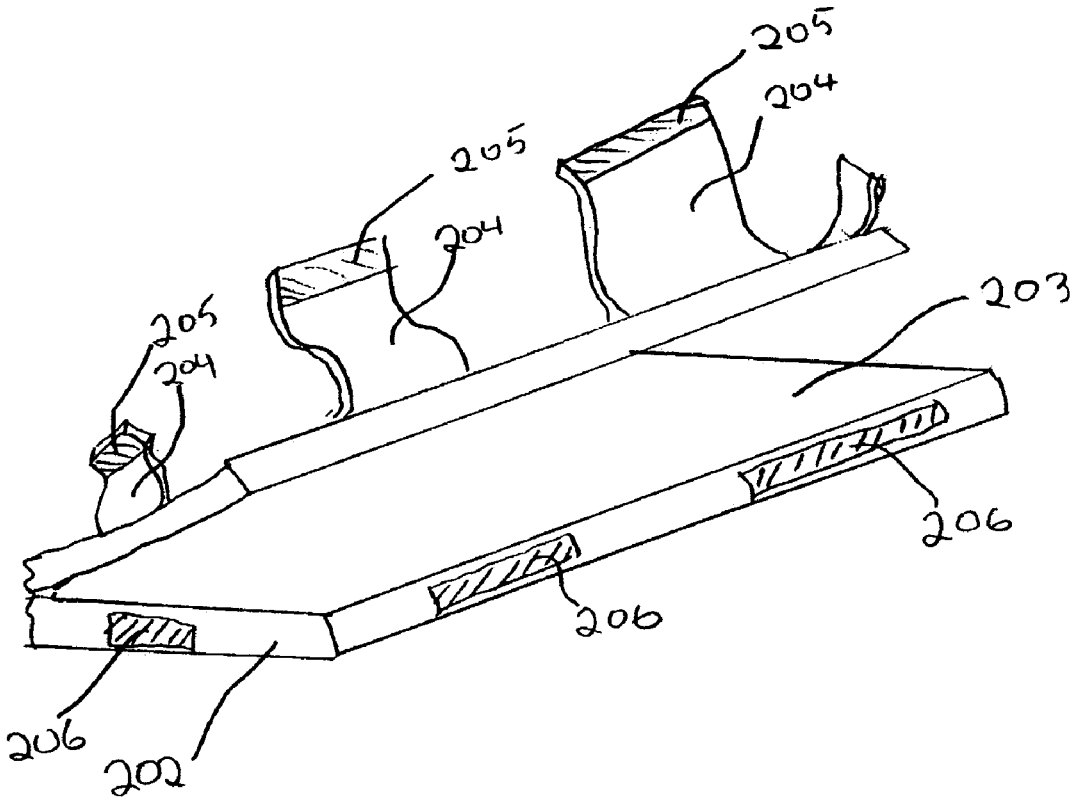
FIG. 4 illustrates a second embodiment of the invention with a kick tail that is modified to store small articles.

FIG. 4 shows an alternate embodiment for a surfboard deck grip kick tail of the present invention. In this embodiment, storage compartment 203 is open on the back and both sides, as shown. An article placed in storage compartment 203 is secured by straps 204, and mating sealing means 205 and 206. Straps 204 may be constructed in accordance with the methods, and made of materials as described for flap 204 in FIG. 3. Also, mating and sealing means may be the same as described in connection with the embodiment of FIG. 3. Alternately, other means may be used for implementing straps 204, for example loops of cords that mate with studs affixed to kick tail body 202. And mating sealing means 205 and 206 may be buttons and button holes, mechanical snap assemblies, etc. . . . as are well known to one of ordinary skill in the art. Storage compartment 203 may have no lining, or it may be lined with a more rigid material as discussed in connection with FIG. 3. In a further embodiment, a removable vessel for storing items may be used in lieu of, or in addition to the lining.

Figure 5:
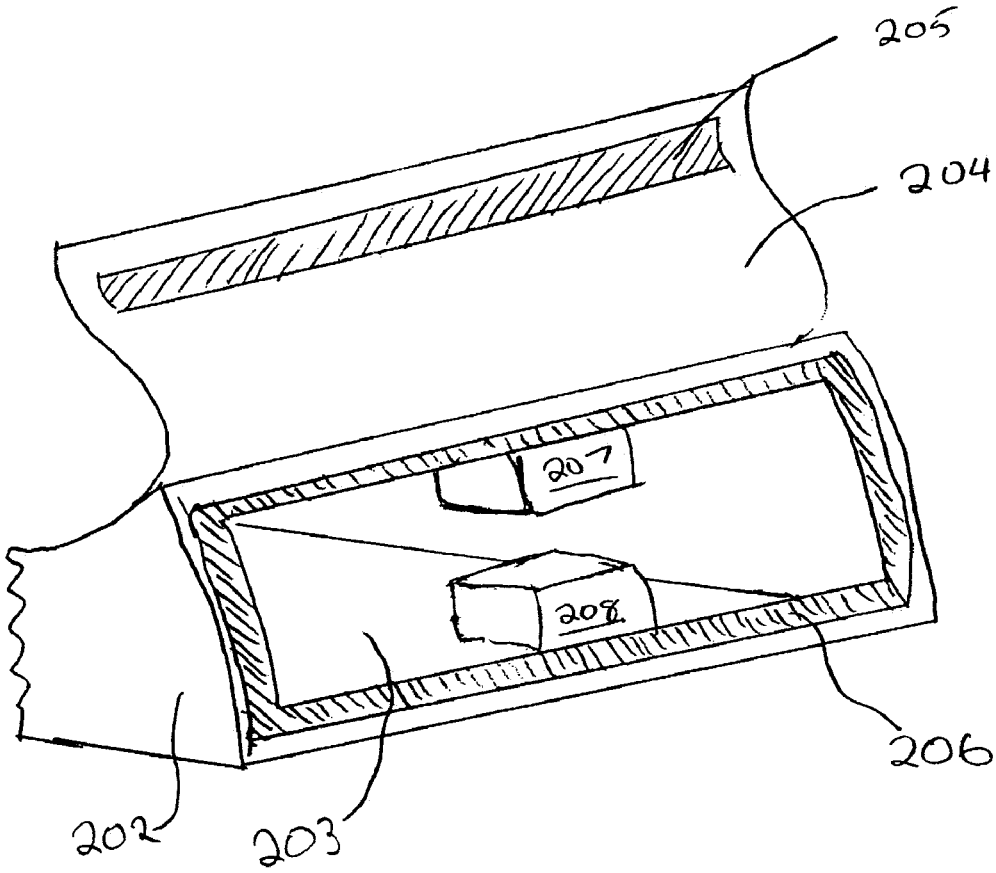
FIG. 5 shows a third embodiment of the invention with a kick tail as in the embodiment of FIG. 3 that further includes strengthening pedestals.

FIG. 5 shows an embodiment of the present invention as described in relation to the embodiment of FIG. 3, but with the addition of strengthening pedestals 207 and 208, to enable storage compartment 203 to resist collapsing. Either one, or both, of the strengthening pedestals 207 and 208 may be present. Additional pedestals may be added in other embodiments for further collapse resistance. In one embodiment, a strengthening pedestal may be molded from the same material as kick tail 202. In another embodiment, a strengthening pedestal may be fabricated from a material that lines kick tail 202. In a further embodiment, a strengthening pedestal may be fabricated of a different material and assembled with kick tail 202, or a liner for kick tail 202.

Figure 6:
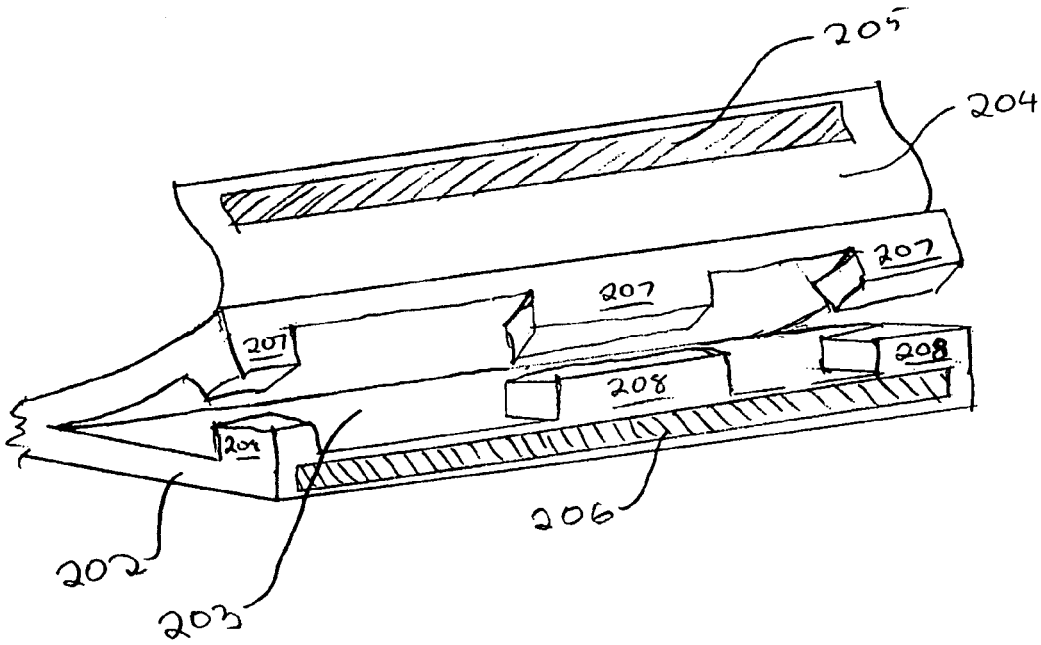
FIG. 6 shows a fourth embodiment of the invention with a kick tail as in the embodiment of FIG. 4 that further includes strengthening pedestals.

FIG. 6 shows an embodiment of the invention having a kick tail 202 with open sides and back as in the embodiment FIG. 4, with a flap 204 as in the embodiment of FIG. 3, and with strengthening pedestals as in the embodiment of FIG. 5, to illustrate how different combinations of embodiment features that have been described so far, can be removed, added, or substituted to derive further embodiments of the invention.

Figure 7:
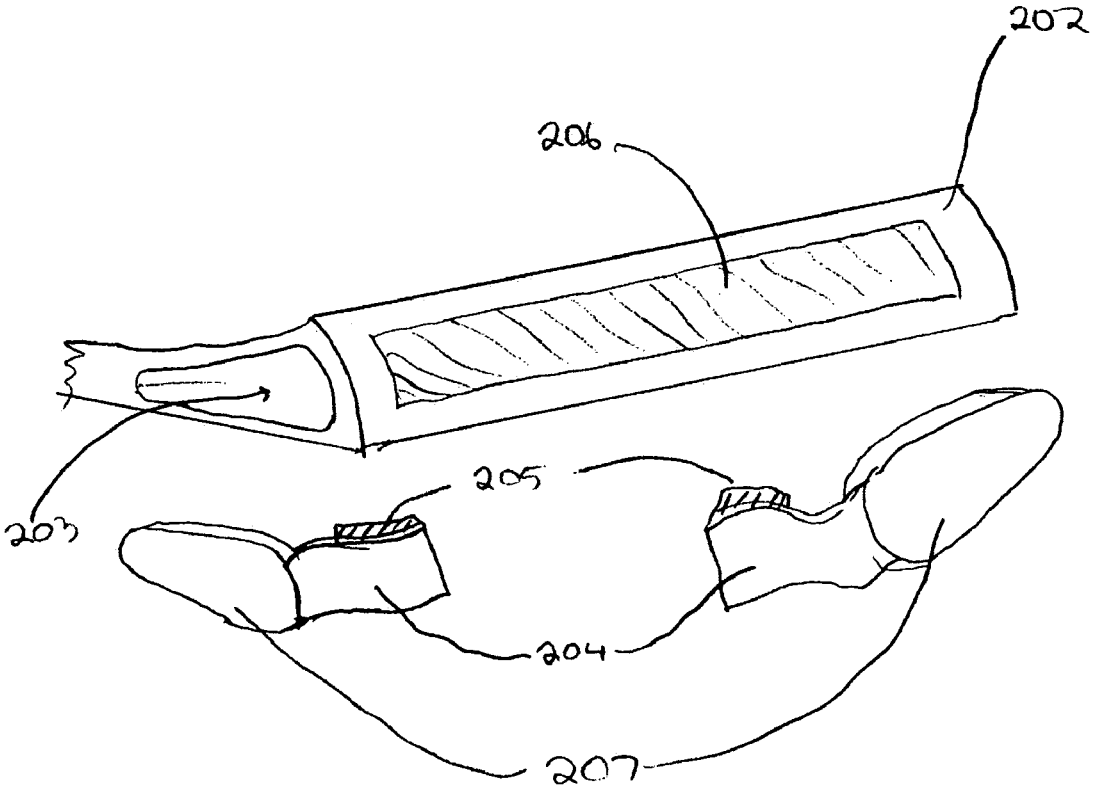
FIG. 7 illustrates a fifth embodiment of the invention with a kick tail having a transverse storage compartment that is sealed with stoppers.

FIG. 7 illustrates another embodiment of the invention, in which kick tail 202 has a transverse cavity 203 with a apertures in each end. Stoppers(s) 207 are inserted into the aperture(s) to seal cavity 203. Strap(s) 204 having attachment means (205) that mate with complementary attachment means 206, affixed to kick tail portion 202, are attached to stopper(s) 207. Strap(s) 204 serve to help secure stopper(s) 207, when inserted, and also serve as handles for facilitating the removal of stopper(s) 207. Attachment means 121 and 122 may be loop and hook materials such as Velcro®, as described above for mating means. Alternately other types of mechanical fasteners may be used such as zippers, buttons and button holes, mechanical snap assemblies, looped cords and securing studs, etc. . . . as are well known to one of ordinary skill in the art.

Figure 8A:
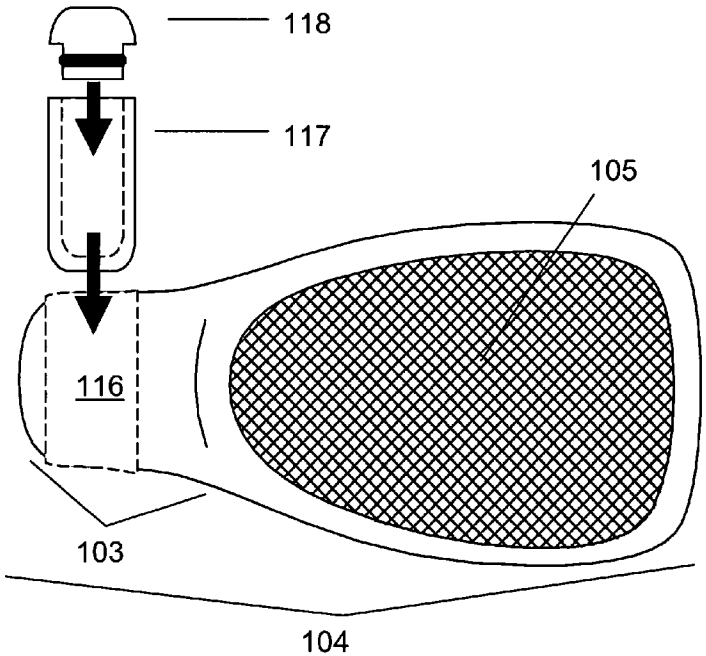
FIGS. 8*a* and 8*b* show top and side views, respectively, of an embodiment of the invention having a kick tail that is modified to hold a storage vessel.
Figure 8B:
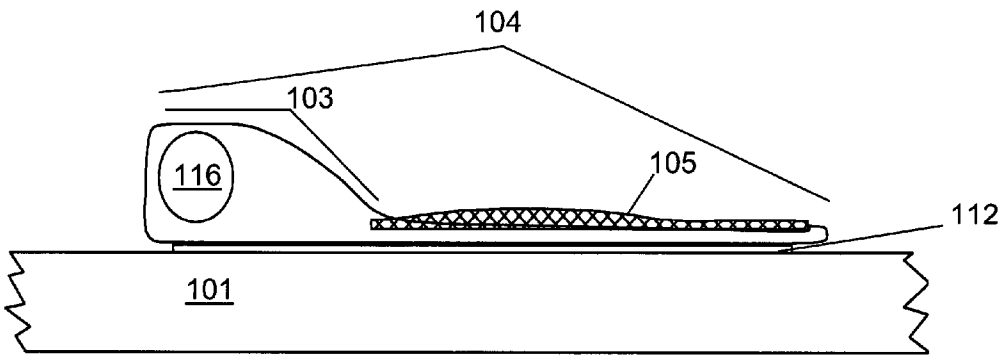

The embodiment pictured in FIG. 8 shows a deck grip 104 having a cavity running transversely through the kick tail portion 102, as shown. FIG. 8*a* shows a disassembled top view, and FIG. 8*b* shows a side view. This cavity may be used to directly store small articles, or may be used to hold an inserted vessel 117 that can hold small articles. As would be apparent to one of ordinary skill in the art, vessel 117 can be made of any appropriate material, such as, for example, plastic, metal, or composite materials. In the illustrated embodiment, vessel 117 has a removable cap 118, that is optionally fitted with a gasket for improved water tightness. Cap 118 may be removably attachable to vessel 117 through a variety of mechanical means (e.g. screw threads) that are easily identified by one of ordinary skill in the art. A potential advantage of the embodiment of FIG. 8 is that vessel 117 may be removed from deck grip 104 and separately used to hold and protect its contents.

In other embodiments, not shown, the transverse cavity may have an aperture at one or both ends. In such embodiments, an aperture may be sealed with a stopper, or with a threaded plug to secure contents within. Sealing gaskets may be optionally used to enhance water tightness.

Referring again to FIGS. 8*a* and 8*b*, deck grip 104 optionally has an enhanced traction area 105. The enhanced traction area 105 may be a specially textured (e.g. with bumps or ridges) finish on deck grip 104. Alternately, enhanced traction area 1 05 may be made of a separate material that is affixed to deck grip 104, using an adhesive or other methods as are well known to those of ordinary skill in the art.

Figure 9A:
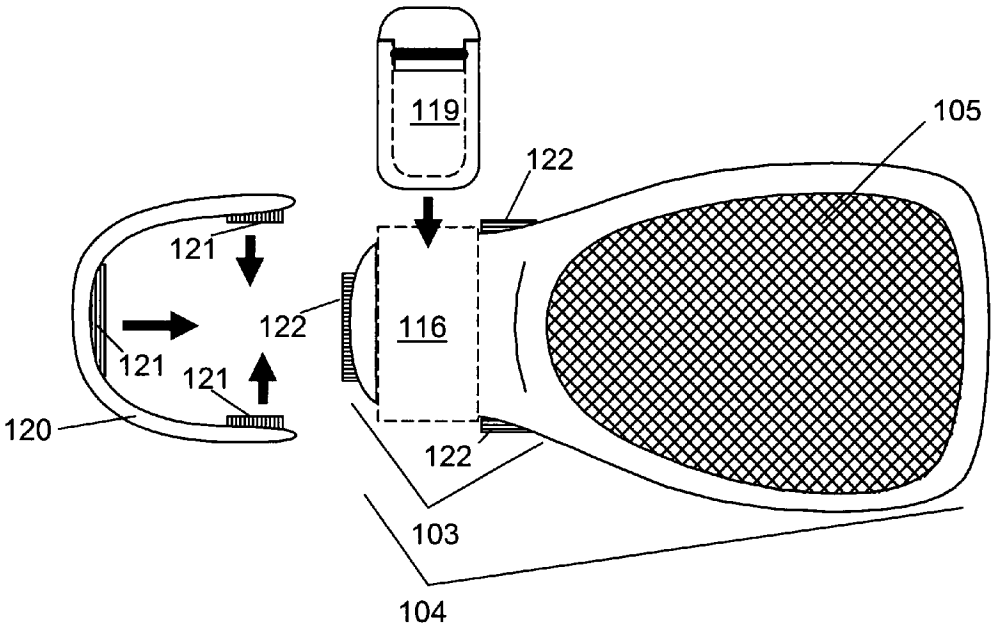
FIGS. 9*a* and 9*b* show disassembled and assembled top views, respectively, of an embodiment of the invention as illustrated in FIG. 8, that further includes additional means for securing a storage vessel.
Figure 9B:
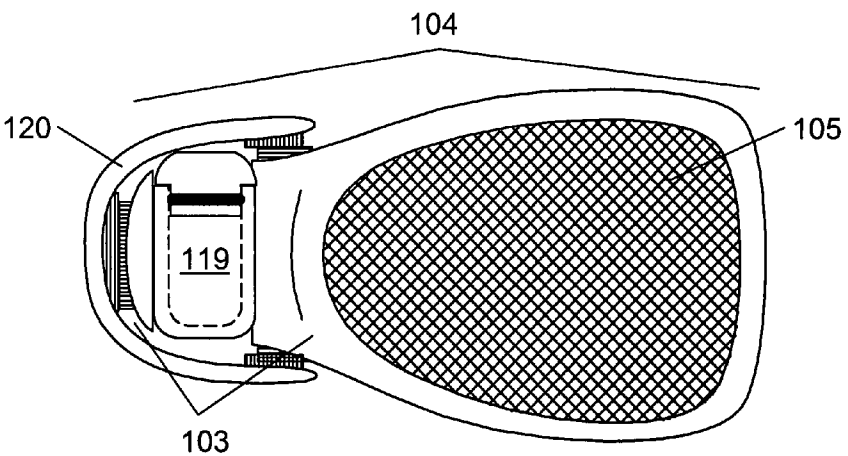
Figure 9C:
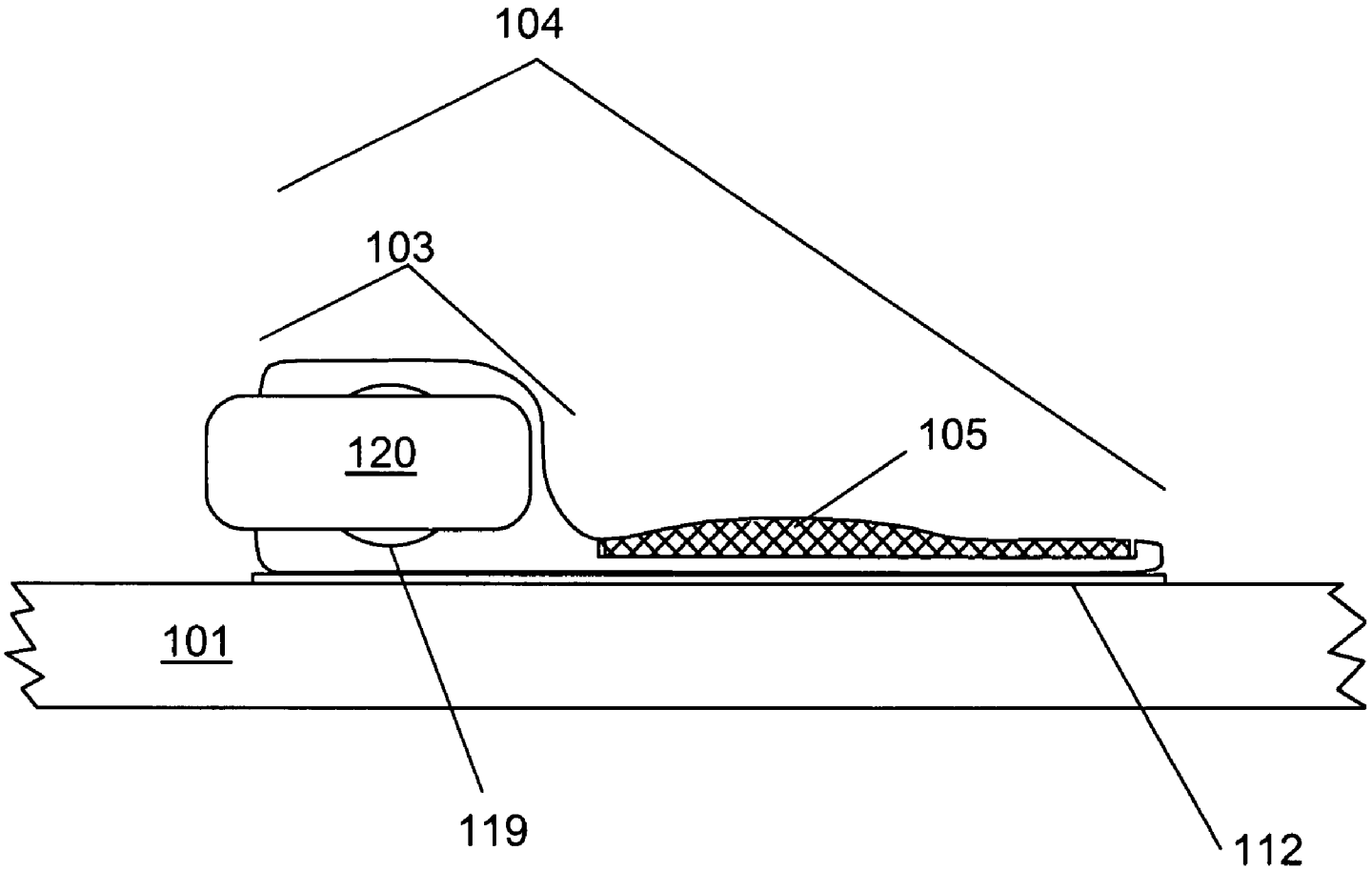
FIG. 9*c* shows a side view of the assembled embodiment shown in FIG. 9*b*.

FIG. 9 shows an embodiment of the invention as in FIG. 8, but with the addition of securing member 120 to further secure vessel 119 in place. FIG. 9*a* is a disassembled top view, and FIG. 9*b* is an assembled side view. Securing member 120 may be a strap of environmentally compatible fabric or a strap of a flexible solid material. In another embodiment, securing member 120 may be a molded plastic part with adequate flexible compliance for attachment and removal. Mating attachments 121 and 122 may be hook and loop materials such as Velcro®. Other types of mechanical fasteners may alternately be used such as zippers, mechanical snaps, buttons and button holes, looped cords and securing studs, etc. . . . as are well known to one of ordinary skill in the art. FIG. 9*c* illustrates a side view of the assembled embodiment, mounted with adhesive 112 to the deck of surfboard 101.

Figure 10A:
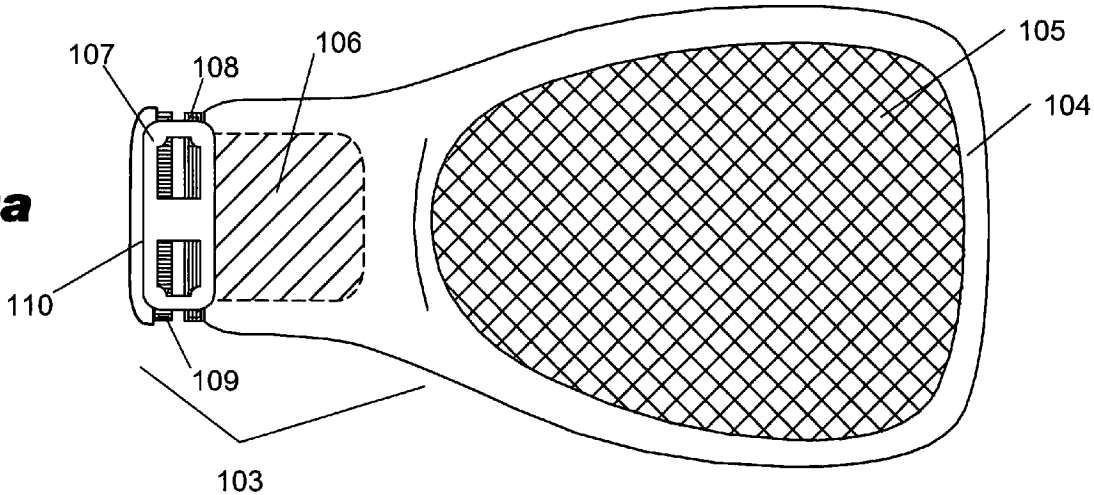
FIGS. 10*a* and 10*b* show top and side views, respectively, of an embodiment of the invention having a hinged cap to seal the storage compartment.
Figure 10B:
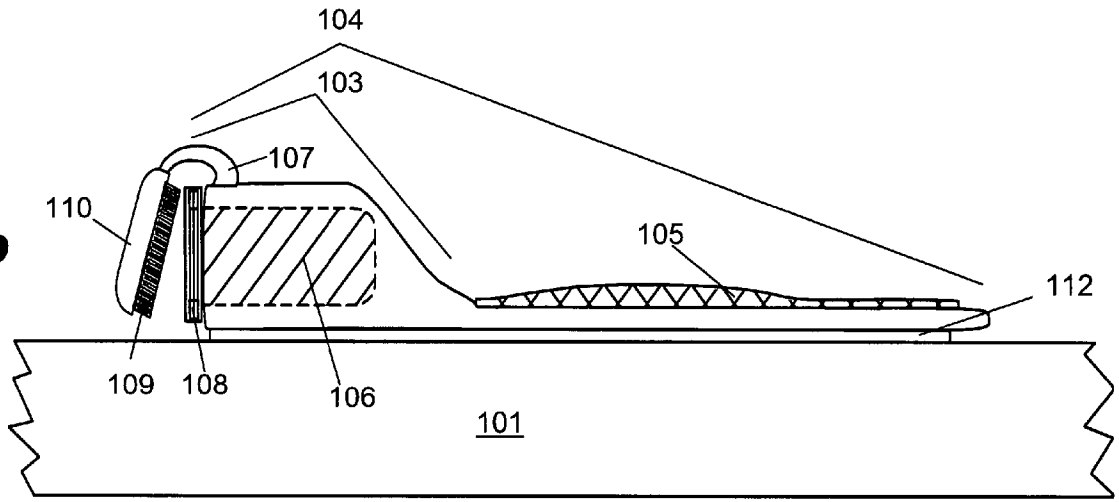

FIGS. 10*a* an 10*b* show top and side views, respectively of another embodiment of the invention having a cap 110 for securing the contents of storage compartment 106 that is attached to deck grip 104 by hinge 107. In some embodiments cap 110, hinge 107, and deck grip 104 can be molded from a single piece of material. In other embodiments, they may be two or more separate pieces that are mechanically assembled to function as a hinge through a variety of means that are well known to one of ordinary skill in the art. In the embodiment illustrated in FIG. 10, mating seals 109 and 108 are affixed to cap 110 and deck grip 104 as shown. The seals may be affixed with adhesives, or through other means that are well known to those of ordinary skill in the art. Mating seals 108 and 109 may, for example, be a hook and loop material such as Velcro®. The hook material may serve either as seal 108 or as seal 109, as long as the mating seal is of the loop material type. In another embodiment, mating seals 108 and 109 may be complementary mechanical seals of the tongue and groove snap-together type, with or without a gasket (not shown) to improve water tightness. In still another embodiment, hinge 107 may be absent. Alternately other types of mechanical fasteners may be used to secure cap 110 in a closed position such as zippers, straps with mechanical snaps or with buttons and button holes, looped cords and securing studs, etc. . . . as are well known to one of ordinary skill in the art. Cap 110 may alternately be threaded to mate with a complementary threaded portion in the aperture to cavity 106. As is previously described embodiments, cavity 106 may include a strengthening lining and/or strengthening pedestals. In a further embodiment, a removable vessel for storing items may be used in lieu of, or in addition to the lining.

Figure 11A:
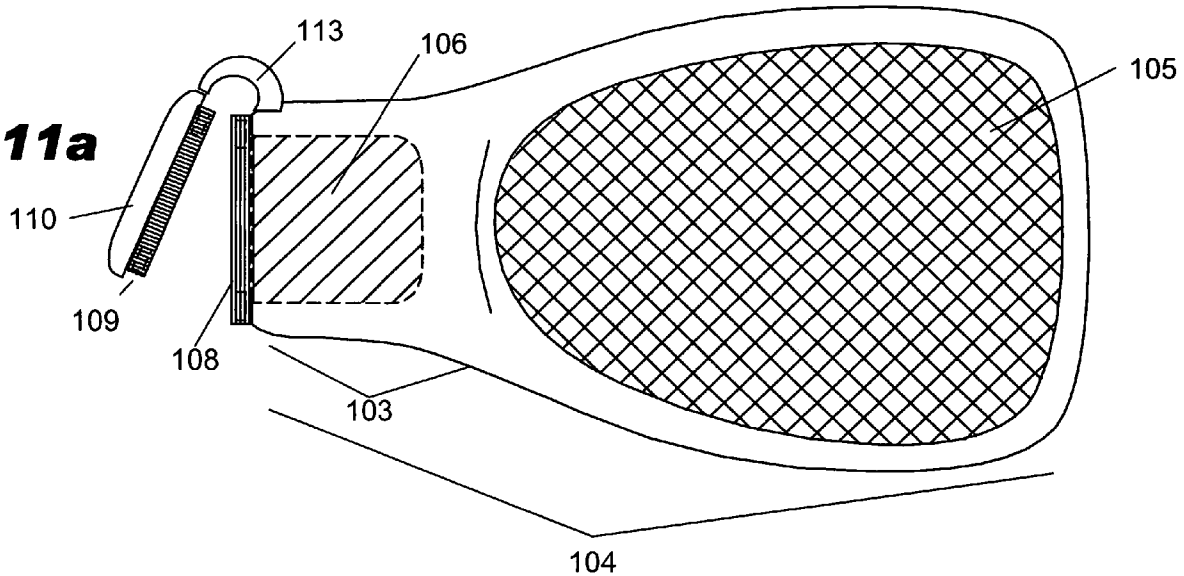
FIGS. 11*a* and 11*b* illustrate top and side views, respectively, of an alternate embodiment having a hinged cap to seal the storage compartment.
Figure 11B:
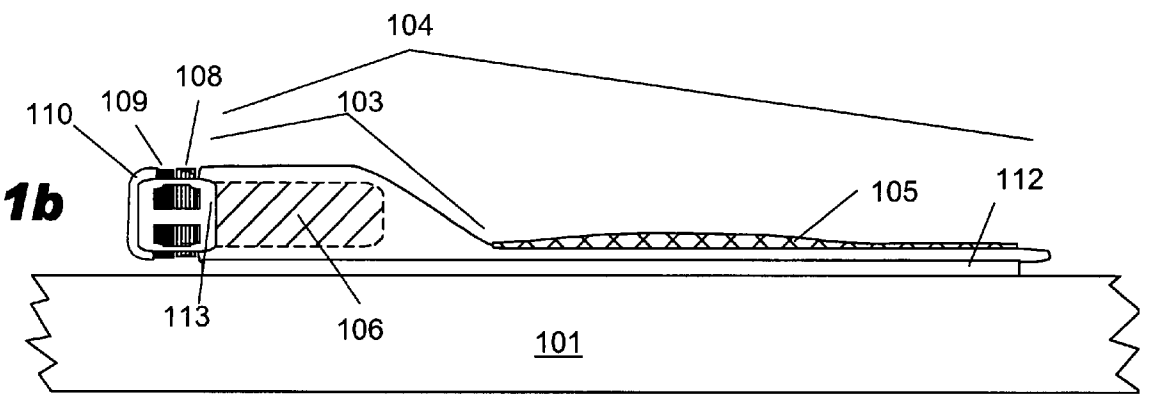

FIG. 11 shows another embodiment of the present invention. It is identical to the embodiment of FIG. 10, except that top hinge 107 of FIG. 4 has been replaced with side hinge 113 of FIG. 5. Otherwise, the above discussion for FIG. 10, also applies to FIG. 11. In some implementations, the side hinge implementation of FIG. 11, may be preferred over the top hinge implementation of FIG. 10, because cap 110 may be easier to open and close with the side hinge owing to reduced mechanical interference from deck 101.

While various embodiments of the present invention have been described above, it should be understood that they have been presented by way of example only, and not of limitation. For example, an aperture allowing access to the hollow compartment has been illustrated as being on the rear, and/or one side, or both sides of the kick tail. Alternately an aperture could be on the top of the kick tail. Alternatively, the location of a storage compartment is not necessarily limited to the kick tail portion of the deck grip but rather may be configured in any desired location within the deck grip, in accordance with the present invention. Additionally, all of the embodiments may are may not have liners of stiffening material, and/or strengthening pedestals. Thus the breadth and scope of the present invention should not be limited by any of the above-described exemplary embodiments, but should be defined only in accordance with the following claims and their equivalents.

What is claimed is:

1. A deck grip for a surfboard comprising:

a traction portion;

a kick tail portion defining a storage compartment;

an aperture in the kick tail portion for access to the storage compartment; and a seal for the aperture, wherein the seal comprises a cap attached to the deck grip by a hinge, and the cap, hinge, and kick tail portion are molded as one unit.

2. The deck grip of claim 1, wherein the seal comprises a flap.

3. The deck grip of claim 1, further comprising a strengthening liner in the storage compartment.

4. The deck grip of claim 1 wherein the storage compartment is watertight when sealed.

5. The deck grip of claim 1 wherein the storage compartment is configured to accept a vessel.

6. A deck grip for a surfboard comprising:

a traction portion;

a kick tail portion defining a storage compartment;

an aperture in the kick tail portion for access to the storage compartment; and a seal for the aperture, wherein the seal comprises a plurality of straps.

7. The deck grip of claim 6, further comprising a strengthening liner in the storage compartment.

8. The deck grip of claim 6 wherein the storage compartment is watertight when sealed.

9. The deck grip of claim 6 wherein the storage compartment is configured to accept a vessel.

* * * * *